US006000180A

United States Patent [19]

Goodman et al.

[11] Patent Number: 6,000,180

[45] Date of Patent: Dec. 14, 1999

[54] PARTITION SYSTEM WITH REMOVABLE COVER PANELS

[75] Inventors: Steven F. Goodman; Kenneth D. Brickner, both of Wyoming; Allen C. Hager, Grand Rapids; Daniel V. Constantino, Wayland, all of Mich.

[73] Assignee: Steelcase Inc., Grand Rapids, Mich.

[21] Appl. No.: 09/005,428

[22] Filed: Jan. 9, 1998

Related U.S. Application Data

[63] Continuation-in-part of application No. 08/767,817, Dec. 17, 1996, Pat. No. 5,802,789.

[51] Int. Cl.[6] ..... E04H 1/00

[52] U.S. Cl. ..... 52/239; 52/238.1; 52/36.1; 160/357

[58] Field of Search ..... 52/239, 238.1, 52/243, 36.1, 36.6, 656.1, 656.2, 656.9, 271, 592.6, 486, 489, 487, 478, 397, 726, 242, 241; 403/231, 230, 375; 160/135, 351

[56] References Cited

U.S. PATENT DOCUMENTS

| | | |
|---|---|---|
| 2,044,637 | 6/1936 | Ross . |
| 2,097,988 | 11/1937 | Ross et al. . |
| 2,947,093 | 8/1960 | Masters . |
| 3,034,184 | 5/1962 | Lindstrom . |
| 3,103,708 | 9/1963 | Pomeroy et al. . |
| 3,328,927 | 7/1967 | Kates . |
| 3,408,127 | 10/1968 | Vincens . |
| 3,557,499 | 1/1971 | Dickie et al. . |
| 3,700,385 | 10/1972 | Sherwood . |
| 3,721,050 | 3/1973 | Perina . |
| 3,722,163 | 3/1973 | Satkin et al. . |
| 3,733,755 | 5/1973 | Butler . |
| 3,744,199 | 7/1973 | Navarre . |
| 3,802,146 | 4/1974 | Tacke et al. . |
| 3,852,927 | 12/1974 | Birum, Jr. . |
| 3,883,196 | 5/1975 | Mohr et al. . |
| 3,906,695 | 9/1975 | Pilgrim et al. . |

(List continued on next page.)

FOREIGN PATENT DOCUMENTS

| | | |
|---|---|---|
| 1233616 | 3/1988 | Canada . |
| 7802908 | 9/1979 | Netherlands . |

OTHER PUBLICATIONS

Packard Officenter 2000, p. 8 (publication date unknown).
The Am Se Co. Open Office Furniture System, p. 22 (publication date unknown).
Transwall Movable Walls and Systems Furniture, Jul. 1995, p. 10.
American Seating System, Jun. 1990.
Herman Miller Ethospace Installation Manual, May 1989.
Teknion, Jul. 1987.
Haworth, The Cygnia Collection List Prices, Jun. 11, 1985, pp. 19–22, 52–53.
Teknion Office Furniture Systems Price Lists, Apr. 1983, p. 33.
Unigroup By Haworth, 1982.
Unigroup By Haworth, Planning For Tomorrow, 1980, p. 10.
Sunar all Systems, PAS Price List, Apr. 1980, p. 19.
G.F. Business Equipment, Inc., Environmental Systems Program, 1973.

*Primary Examiner*—Creighton Smith
*Attorney, Agent, or Firm*—Price, Heneveld, Cooper, DeWitt & Litton

[57] ABSTRACT

A partition construction includes a partition frame having a frame member. A cover panel covers a side of the partition frame. The partition includes a connection system on the cover panel that releasable attaches the cover panel to the partition frame. The connection system includes a plurality of top clips on the cover panel adjacent an upper edge that positively engage the partition frame. The connection system further includes a plurality of bottom fingers extending below a lower edge of the cover panel and engaging at least a selected one of a lower cover panel and a frame member located below the cover panel in a juxtaposed relationship.

32 Claims, 7 Drawing Sheets

U.S. PATENT DOCUMENTS 3,948,011 4/1976 Price et al. .
3,998,018 12/1976 Hodges .
4,018,020 4/1977 Sauer et al. .
4,031,675 6/1977 Roberts et al. .
4,038,799 8/1977 Shanks .
4,103,981 8/1978 Donahue et al. .
4,123,879 11/1978 Blodee et al. .
4,128,979 12/1978 Price .
4,205,815 6/1980 Sauer et al. .
4,213,516 7/1980 Sulewsky .
4,224,769 9/1980 Ball et al. .
4,248,325 2/1981 Georgopoulos .
4,255,910 3/1981 Wendt .
4,263,764 4/1981 Wendt .
4,372,629 2/1983 Propst et al. .
4,375,010 2/1983 Mollenkopf .
4,423,573 1/1984 Ombolt et al. .
4,535,577 8/1985 Tenser et al. .
4,631,881 12/1986 Charman .
4,665,662 5/1987 Swanborn .
4,685,255 8/1987 Kelley .
4,704,835 11/1987 Jordan .
4,771,583 9/1988 Ball et al. .
4,782,642 11/1988 Conville .
4,905,428 3/1990 Sykes .
4,995,605 2/1991 Conville .
5,038,539 8/1991 Kelley et al. .
5,062,246 11/1991 Sykes .
5,175,969 1/1993 Knauf et al. .
5,301,484 4/1994 Jansson .
5,394,658 3/1995 Schreiner et al. .
5,400,560 3/1995 Hellwig et al. .
5,426,904 6/1995 Gilmore .
B1 4,876,835 6/1992 Kelly et al. .

PARTITION SYSTEM WITH REMOVABLE COVER PANELS

CROSS-REFERENCES TO RELATED APPLICATIONS

The present application is a continuation-in-part of consigned, U.S. patent application Ser. No. 08/767,817, filed Dec. 17, 1996, now U.S. Pat. No. 5,802,789, entitled PARTITION CONSTRUCTION INCLUDING REMOVABLE COVER PANELS, the entire contents of which are incorporated herein by reference.

BACKGROUND OF THE INVENTION

The present invention relates to an office partition panel system with removable decorative covers that have movable fingers adjacent their lower edge for retaining the covers to the panel frame.

Modern offices and work environments use partition panels to subdivide work space. The partition panels often include vertically slotted posts and frames configured to support hang-on accessories and furniture, such as work surfaces, shelves, overhead cabinets and the like. Further, they include cover panels shaped to cover the frames but to allow access to the slots in the frames. Sometimes, the cover panels are removable so that utilities carried in the frames can be accessed. A problem with removable covers is that they must be tightly secured so that they do not rattle or exhibit looseness. Also, the show surfaces of the cover panels must be held flush to adjacent cover panels to provide a good appearance, even if the cover panels are slightly warped or bowed. At the same time, the cover panels must be readily removable or they defeat the purpose of being removable.

Another problem is that it is difficult to install cover panels having clips, hooks or projections since these connecting features must be accurately aligned with holes in partition frames for connection. However, since the connecting features are on a back side of the cover panel, the alignment and connection process is a blind connection process. This problem is aggravated by normal dimensional variations in partition frames and cover panels, which dimensional variations cause misalignment and difficult attachment. A cover panel connection system is desired that compensates for these significant dimensional variations in the partition frames and cover panels. Further, a cover panel connection system is desired that is secured, but that permits ready assembly and disassembly of the cover panels from their respective frames, and in particular which captures edges of the cover panels to closely control the flushness relative to adjacent cover panels. This is particularly true of vertically adjacent cover panels, since differences in flushness where a lower panel is outboard of an upper panel creates a ledge that is visually unexceptable to consumers.

Recently, a novel partition system was conceived where the partition frame incorporated a plurality of horizontal frame members with horizontally slotted faces. Advantageously, the slots provide regularly spaced point specific attachment locations, allowing furniture components and accessories to be attached at selected horizontal locations for optimal efficiency. The point specific attachment locations also allow the furniture components and accessories to be installed with great accuracy, but without the need for any measuring by installers. Basically, the installers (or users) count the number of slots to the desired attachment location, and then install their component in an optimal location. A problem can occur if the clips of the cover panel connection system interfere with selecting a particular slot, since this would prevent using the selected slot for the attachment purpose. A cover panel is desired that does not interfere with selection of a particular attachment location. Presently available cover panels are not compatible with partition frames having horizontal rows of slots for supportive hang-on accessory units since the presently available cover panels have fixed clips and connectors that may interfere with the mounting of hang-on accessory units.

Accordingly, a system solving the aforementioned problems is desired.

SUMMARY OF THE INVENTION

One aspect of the present invention is to provide a partition construction including a partition frame, and upper and lower cover panels that cover a side of the partition frame. A connection system on the upper cover panel releasable attaching the upper cover panel to the partition frame, the connection system including a plurality of top clips adjacent an upper edge of the cover panel that positively engage the partition frame, and further including a plurality of bottom fingers extending below a lower edge of the upper cover panel that engage at least a selected one of the lower cover panel and the partition frame at a location below the upper cover panel.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
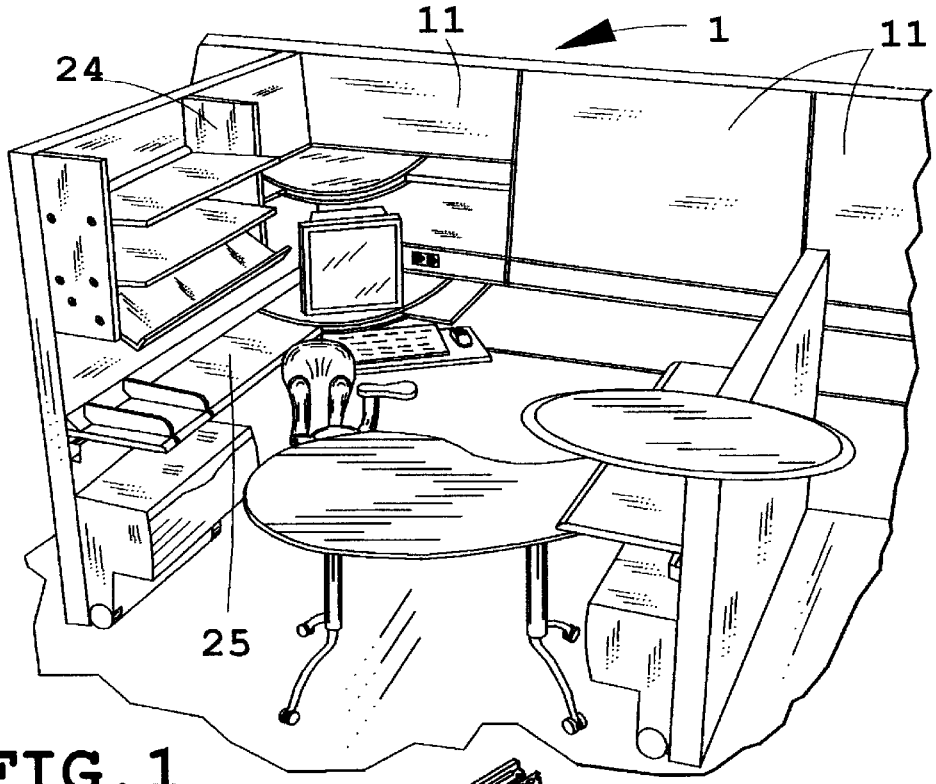
FIG. 1 is a fragmentary, perspective view of a partition system of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
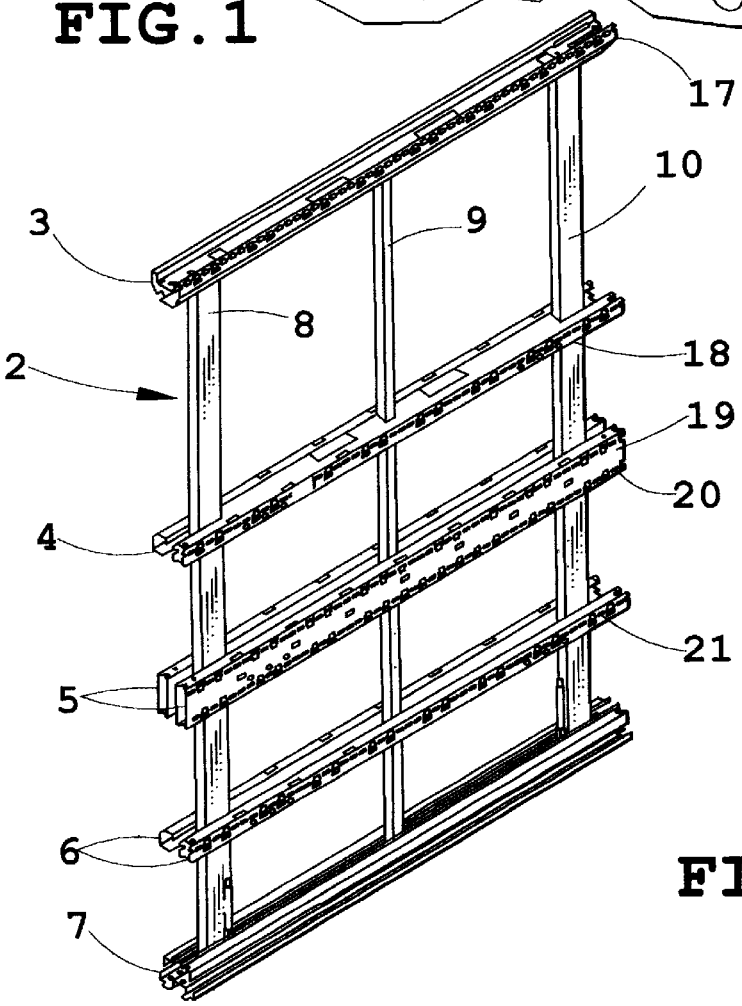
FIG. 2 is a perspective view of the partition frame of FIG. 1.
Figure 3:
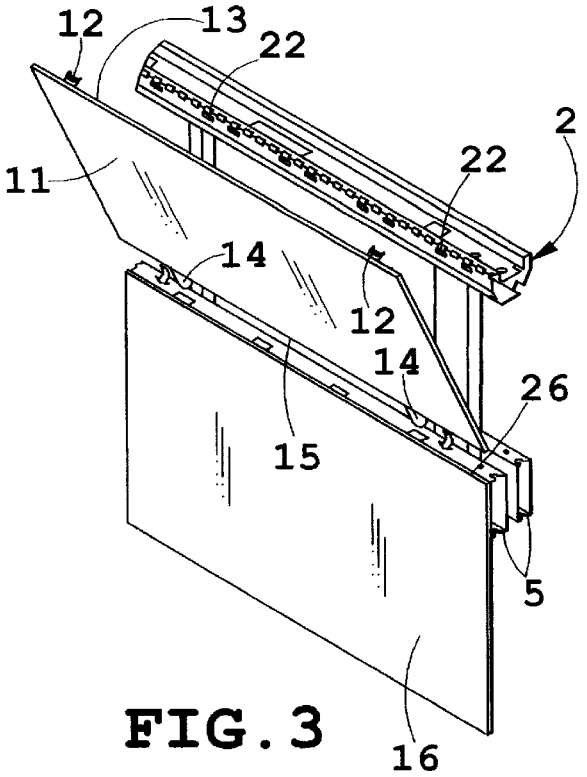
FIG. 3 is a fragmentary, perspective view of the partition system of FIG. 1 showing the installation of the cover panel.

With reference to FIGS. 1, 2 and 3, the partition system or construction 1 includes a partition frame 2, includes horizontal frame members 3, 4, 5, 6 and 7 and vertical frame members 8, 9 and 10. The partition system also includes a cover panel 11 covering a side of the partition frame 2. The partition 1 further includes a connection system on the cover panel 11 that releasable attaches the cover panel 11 to the partition frame 2. The connection system includes a plurality of top clips 12 on the cover panel 11 adjacent an upper edge 13 of the cover panel 11. The clips 12 positively engage the partition frame 2. The connection system further includes a plurality of bottom fingers 14 (FIG. 3) that extend below a lower edge 15 of the cover panel 11 and engage at least a selected one of a lower cover panel 16 and a frame member such as horizontal member 5 located below the upper cover panel 11 in a juxtaposed relationship thereto.

The horizontal frame members each include horizontal rows of evenly-spaced discrete attachment locations such as slots 17, 18, 19, 20 and 21 which provide attachment locations for hang-on accessory units such as storage shelves and bins 24, work surfaces 25 and the like. The bottom fingers 14 of the cover panel 11 are pivotably mounted to the cover panel 11 to allow access to the horizontal slots if required for mounting of a hang-on accessory unit.

Figure 6:
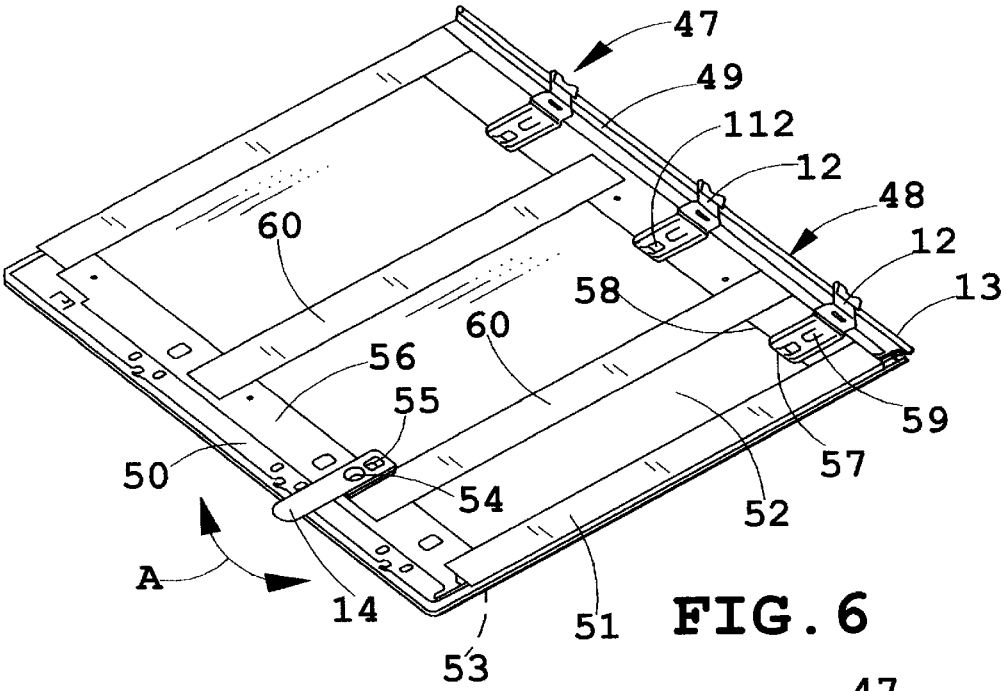
FIG. 6 is a perspective view of the cover panel of FIG. 1 wherein the cover panel includes a tackable outer surface.
Figure 7:
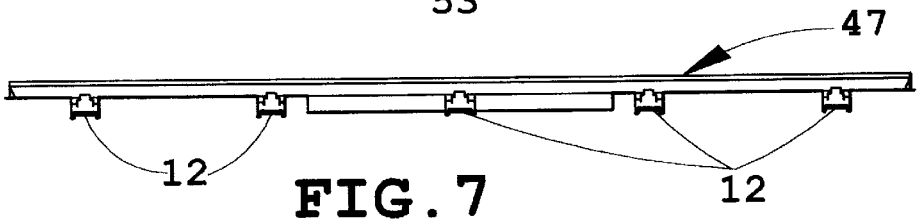
FIG. 7 is a top elevational view of the tackable cover panel of FIG. 1.
Figure 8:
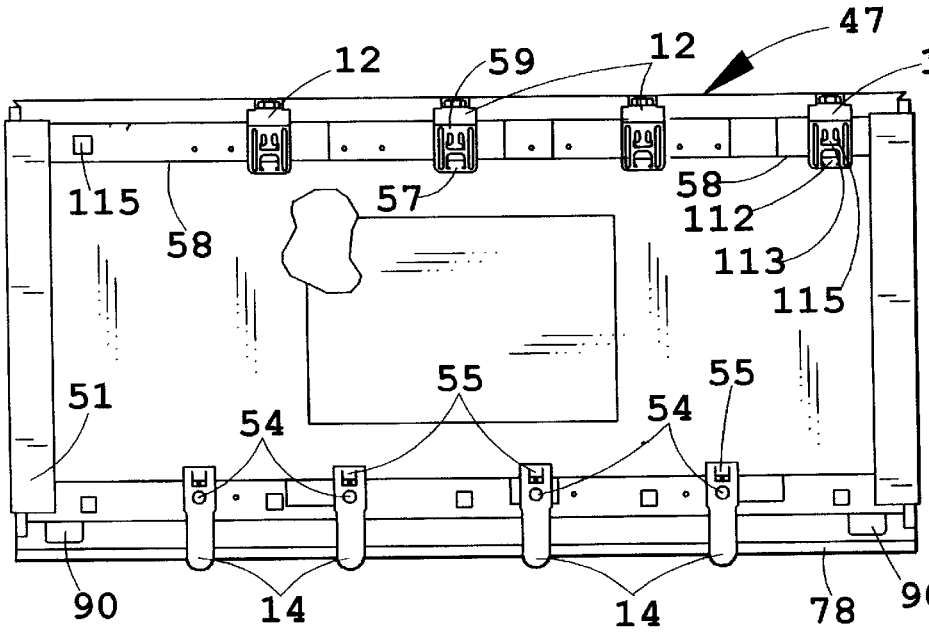
FIG. 8 is a front elevational view of the tackable cover panel of FIG. 1.
Figure 9:
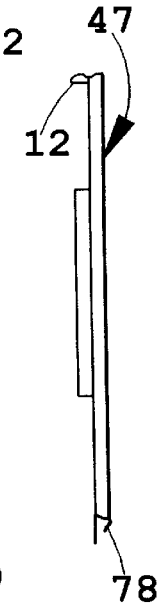
FIG. 9 is a side elevational view of the tackable cover panel of FIG. 1.

In the embodiment illustrated in FIG. 6, the cover panel 11 comprises a tackable cover panel 47. The tackable cover panel 47 includes a perimeter frame 48 having upper and lower horizontal members 49, 50, respectively, and a pair of vertical side members 51 which form a rigid perimeter frame. A sheet of acoustic insulation 52 extends across the frame 48, and is covered by fabric 53 on the outer side of the cover panel 47. The bottom finger 14 is pivotally mounted to the frame 48 at pivot 54 for rotation in the direction of the arrow "A" about an axis that is orthogonal to the plane of the cover panel 11. A flexible tab 55 on the finger 14 extends towards the frame 48, and frictionally engages an inner surface 56 thereof, thereby maintaining the finger 14 at a selected position. As described in more detail below, the top clips 12 used with the tackable cover panel 47 comprise clips 110 that include a base portion 59 with a retainer clip 57 that retains the clip 12 to the tackable cover panel 47 along the edge 58 of the upper horizontal frame member 49. In FIG. 8, the upper left clip 110 has been removed to show the rectangular aperture 115 that retains the clip 110, also described in more detail below. Metal braces 60 are TOG-L-LOC'D to the upper and lower frame members 49 and 50 to provide additional strength.

Figure 10:
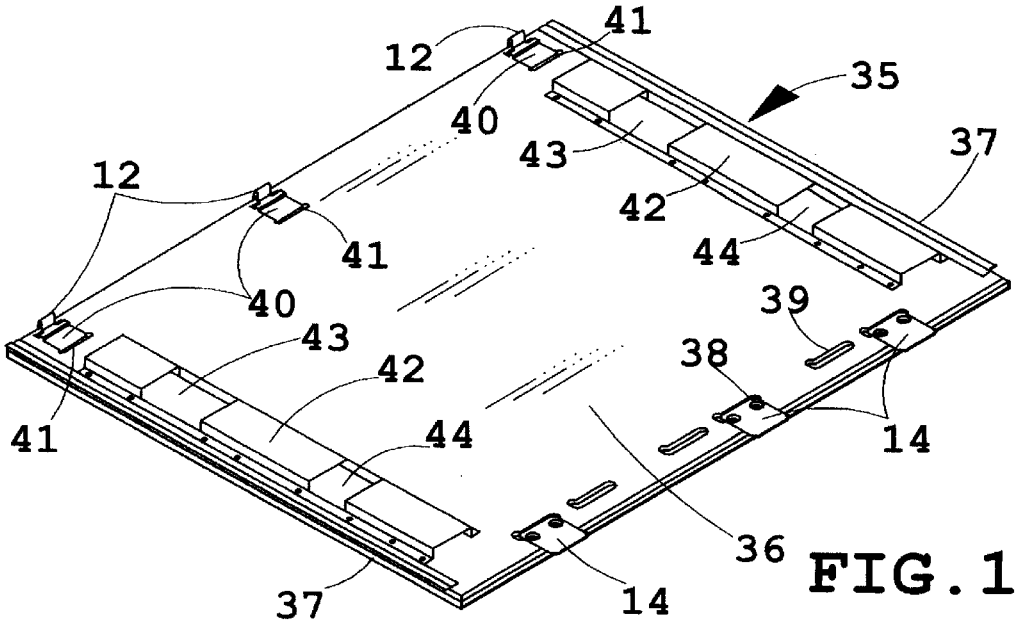
FIG. 10 is a perspective view of the cover panel of FIG. 1 wherein the cover panel includes a wood sheet.

With reference to FIG. 10, the cover panel 11 may comprise a wood cover panel 35. The wood cover panel 35 includes a body portion 36 having a laminated sheet construction with a pair of vertical edge trim strips 37 fastened thereto. The fingers 14 on the wood cover panel 35 are fastened into slots 39 by screws 38. The fingers 14 may include a flange or protrusion that extends into the slot 39 to locate the finger 14. If access to the horizontal row of slots in the horizontal frame member is required, the fingers 14 may be moved to an adjacent slot 39, thereby providing clearance for mounting hang-on accessory units such as work surfaces or storage bins. The top clips 12 are secured to the body portion 36 by screws 40. The top clips 12 are located in the correct position by slots 41. Top clips 12 may include a flange or protrusion extending into a slot 41 to locate the clip in the correct position. A pair of U-shaped stiffener brackets 42 extend along the side edges of the cover panel 35 and include upper and lower cut-out portions 43, 44, respectively.

Figure 11:
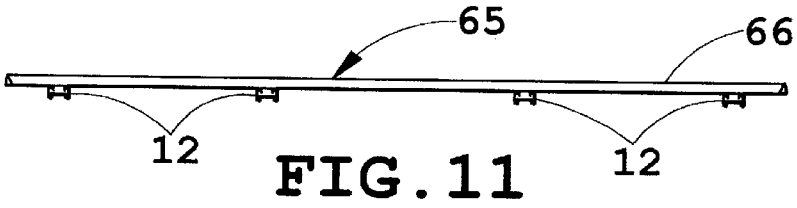
FIG. 11 is a top elevational view of the cover panel of FIG. 1 wherein the cover panel is a non-tackable sheet metal cover.
Figure 12:
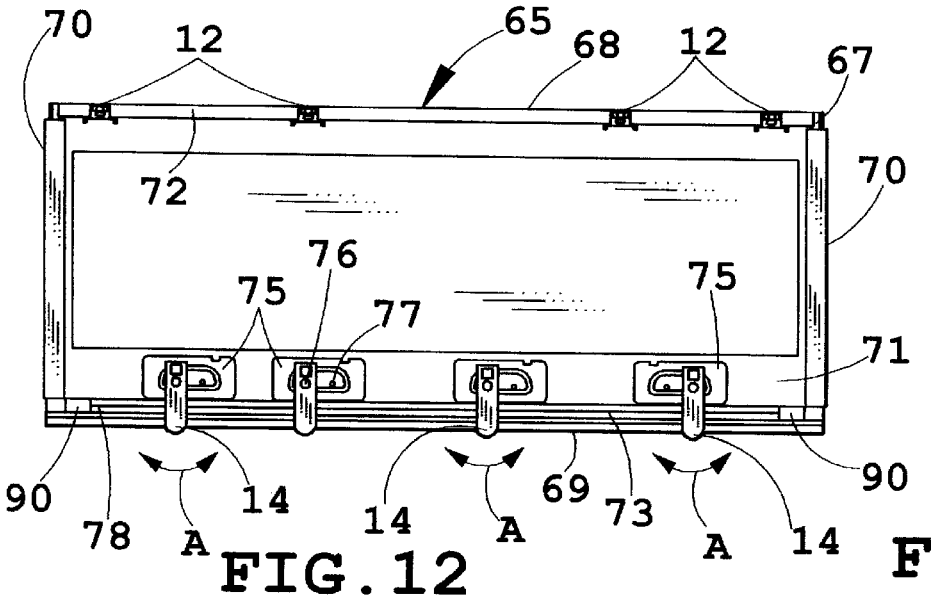
FIG. 12 is a front elevational view of the non-tackable cover panel of FIG. 1.
Figure 13:
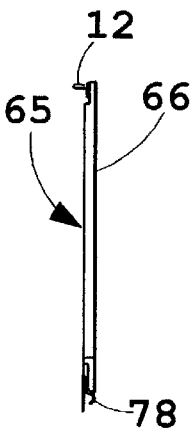
FIG. 13 is a side elevational view of the non-tackable cover panel of FIG. 1.

With reference to FIGS. 11–13, a non-tackable panel 65 has a flat sheet metal skin 66 with an inwardly-extending flange 67 extending along the top and bottom edges 68 and 69 and the side edges 70. Each finger 14 is pivotally mounted to a bracket 75 at a first pivot 76, or a second pivot 77. A flexible seal 78 extends along the bottom edge 69 of the panel 65 to block light and sound from passing through the assembled partition panel. The seal 78 is retained to the lower flange 73 by a pair of clips 90. As described in more detail below, the non-tackable top clips 12 comprise clips 100, each of which includes clip portions 107 and 108 that retain the clip 12 on the upper flange 72.

Figure 14:
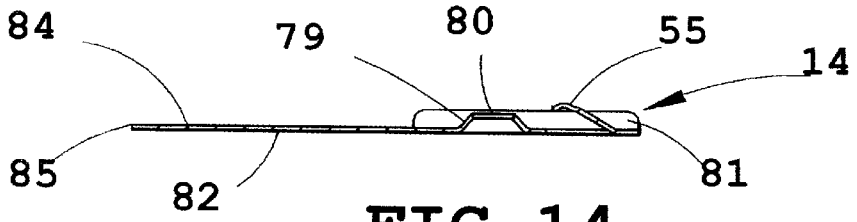
FIG. 14 is a cross-sectional view of the pivotable finger taken along the line XIV—XIV of FIG. 15.
Figure 15:
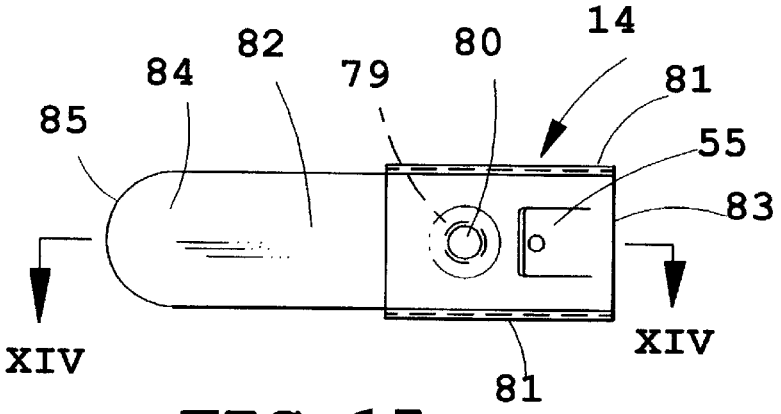
FIG. 15 is a front elevational view of the pivotable finger of FIG. 3.
Figure 16:
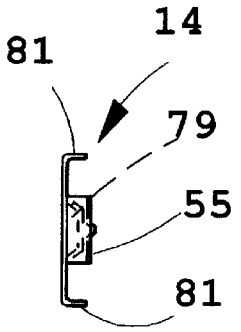
FIG. 16 is a side elevational view of the pivotable finger of FIG. 3.

With reference to FIGS. 14–16, each of the pivoting fingers 14 include a flexible tab 55, a raised portion 79 with a clearance hole 80 for pivotally mounting the finger 14 to a cover panel. The finger 14 includes a body portion 82 with a pair of orthogonal reinforcement flanges 81 extending along the sides of the body portion 82 adjacent the base end 83. The opposite end 84 curves slightly, and defines a semi-circular edge 85.

Figure 17:
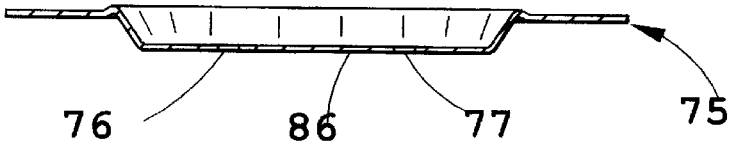
FIG. 17 is a cross-sectional view of the finger mounting bracket taken along the line XVII—XVII of FIG. 18.
Figure 18:
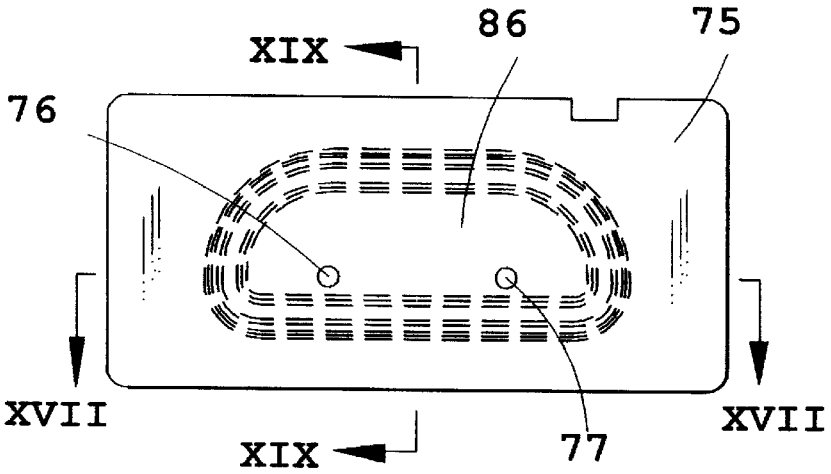
FIG. 18 is a front elevational view of the finger mounting bracket of FIG. 12.
Figure 19:
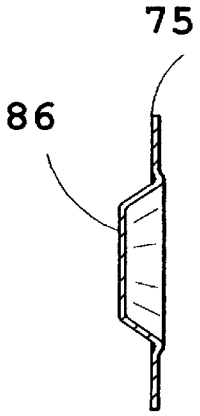
FIG. 19 is a cross-sectional view of the finger mounting bracket taken along the line XIX—XIX of FIG. 18.

With reference to FIGS. 17–19, each bracket 75 is formed from sheet metal, and includes first and second clearance holes forming pivots 76 and 77, respectively, for mounting the finger 14. The flexible tab 55 of the finger 14 contacts the raised portion 86 of the mounting bracket 75 to frictionally retain the finger 14 in the desired angular position. The flexible tab 55 also biases the finger outwardly, away from the panel to assist in keeping the cover panels in a plane with each other across vertical joints.

Figure 20:
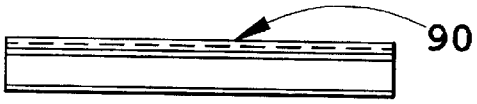
FIG. 20 is a top elevational view of the horizontal seal clip of FIG. 8.
Figure 21:
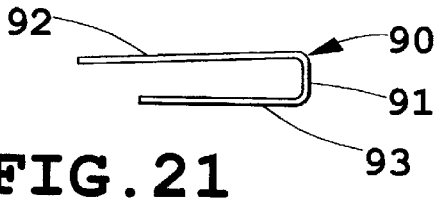
FIG. 21 is a side elevational view of the horizontal seal clip of FIG. 8.
Figure 22:
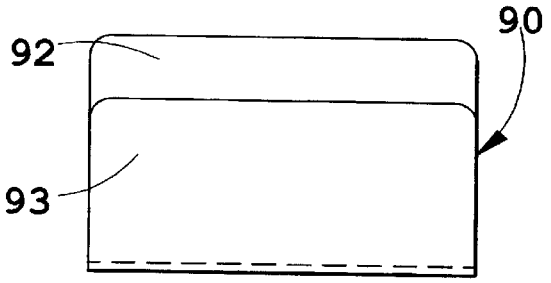
FIG. 22 is a front elevational view of the horizontal seal clip of FIG. 8.
Figure 23:
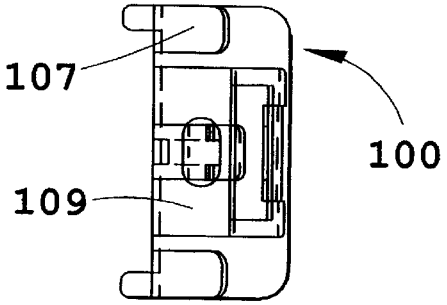
FIG. 23 is a top plan view of the V-shaped cover-retaining clip that is used with the non-tackable cover panel of FIG. 12.
Figure 24:
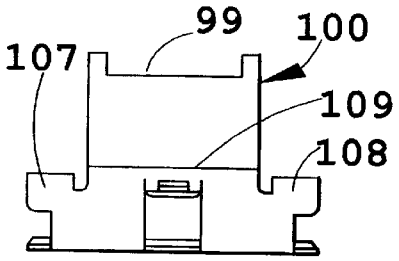
FIG. 24 is a left side elevational view of the V-shaped cover-retaining clip used with the non-tackable cover panel of FIG. 12.
Figure 25:
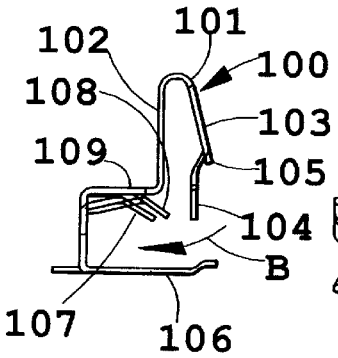
FIG. 25 is a side elevational view of the V-shaped cover-retaining clip used with the non-tackable cover panel of FIG. 12.
Figure 26:
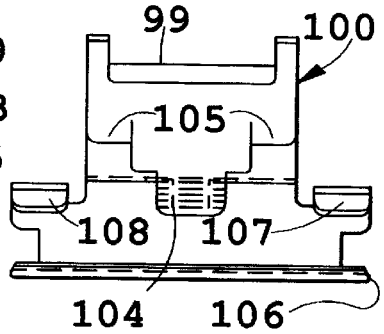
FIG. 26 is a right side elevational view of the V-shaped cover-retaining clip used with the non-tackable cover panel of FIG. 12.
Figure 27:
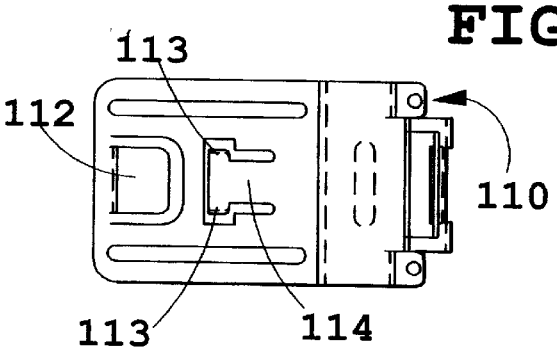
FIG. 27 is a top plan view of the V-shaped cover-retaining clip used with the tackable cover panel of FIG. 8.
Figure 28:
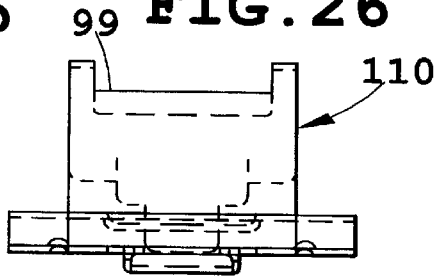
FIG. 28 is a left side elevational view of the V-shaped cover-retaining clip used with the tackable cover panel of FIG. 8.
Figure 29:
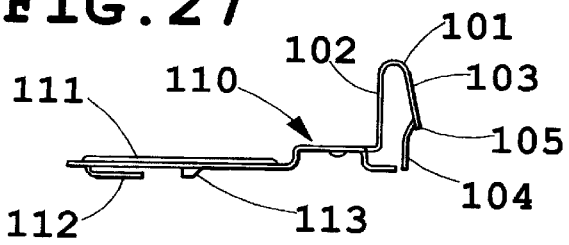
FIG. 29 is a side elevational view of the V-shaped cover-retaining clip used with the tackable cover panel of FIG. 8.
Figure 30:
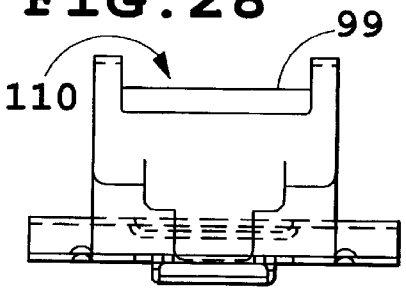
FIG. 30 is a right side elevational view of the V-shaped cover-retaining clip used with the tackable cover panel of FIG. 8.

As illustrated in FIGS. 20–22, the clip 90 that retains the seal 78 has a generally U-shaped cross section with a web 91 and first and second legs 92 and 93 that extend inwardly towards one another at a slight angle. Clip 90 is preferably made from spring steel to permit the legs 92 and 93 to flex outwardly upon installation of the clip 90 over the seal 78 to thereby retain the seal 78 on the cover panel.

Top clip 12 may comprise a non-tackable panel clip 100 illustrated in FIGS. 23–26 or may comprise a tackable clip 110 illustrated in FIGS. 27–30. The non-tackable panel clip 100 includes a V-shaped portion 101 that is transversely oriented when the clip 100 is installed to a non-tackable panel 65. The V-shaped portion 101 includes first and second legs 102, 103 with an extension 104 extending from the second leg 103. Leg 102 flexes toward leg 103 upon insertion into an aperture 22 (FIG. 3) in the partition frame 2. When the V-shaped portion 101 is fully inserted into the aperture 22 in the frame 2, leg 103 flexes outwardly somewhat such that the retainer tab 105 abuts the inner surface of the horizontal frame member, thereby retaining the tab to the frame member. As described in more detail below, a tool 23 (FIG. 5) may be used to push the extension tab 104 in the direction of the arrow "B" (FIG. 25) to thereby flex leg 103 toward leg 102 and moving retainer tab 105 out of contact with the inner surface of the horizontal frame member such that the clip 100 may be removed from the partition frame 2. A pair of clips 107 and 108 retain the non-tackable panel clip 100 on the upper flange 72 of the panel 65. The flange 72 is snugly received between the clips 107, 108 and the lower wall 109 of the non-tackable panel clip 100. The lower leg 106 of the clip 100 abuts the inner side of sheet metal skin 66 of the panel 65, and provides further support for the non-tackable panel clip 100. The V-shaped portion 101 of the non-tackable panel clip 100 is cut-out at 99 to lower the effort required to flex leg 103 towards leg 102 during installation or removal of the cover panel.

The clip 110 illustrated in FIGS. 27–30 is used for the tackable panel 47. The V-shaped portion 101 is substantially the same as described above with respect to the nontackable panel clip 100. The base portion 111 of the tackable panel clip 110 includes a clip 112 that is received over the edge 58 of the upper horizontal cover panel frame member 49 (FIG. 6). A pair of small tabs 113 extend from the flexible arm 114 on the base 111 of the tackable panel clip 110. The small tabs 113 are received in a rectangular aperture 115 in the frame 48 of the cover panel 47 (FIG. 8). The clip 112 and tabs 113 cooperate to retain the tackable panel clip 110 to the cover panel 47.

Figure 31:
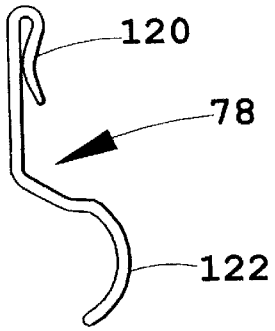
FIG. 31 is an end view of the horizontal light seal.

With reference to FIG. 31, the horizontal seal 78 includes a clip portion 120 that retains the seal 78 on the edge 121 of the lower flange of the cover panel. The flexible lower portion 122 abuts the upper edge of the cover panel immediately below, thereby preventing the transmission of light and sound between adjacent office spaces.

Figure 32:
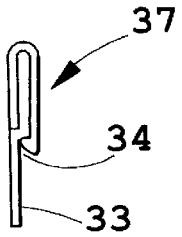
FIG. 32 is an end view of the side edge trim strip.
Figure 33:
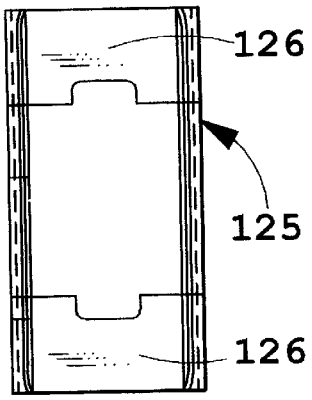
FIG. 33 is a top plan view of a panel clip.
Figure 34:
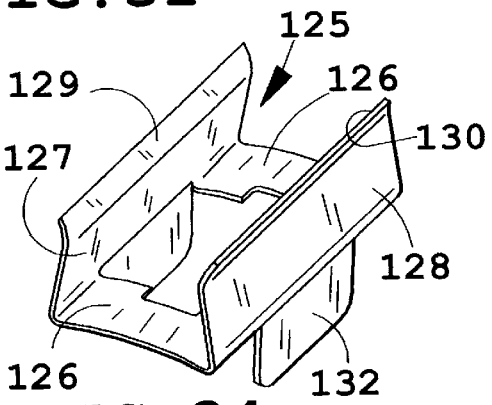
FIG. 34 is a perspective view of a panel clip.

With reference to FIG. 32, the edge trim strip 37 acts as a light and sound block along the vertical side edges of the cover panels. A clip portion 34 retains the trim strip 37 on the flange along the side edge of the cover panel. Flexible end 33 abuts a vertical frame member to further ensure that light and sound is not transmitted between adjacent office spaces.

Figure 35:
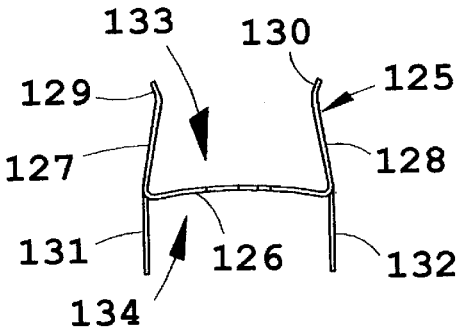
FIG. 35 is a front elevational view of a panel clip.
Figure 36:
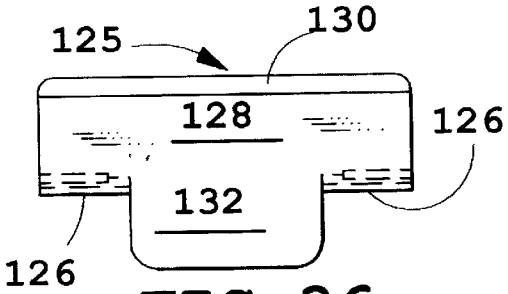
FIG. 36 side elevational view of a panel clip.
Figure 37:
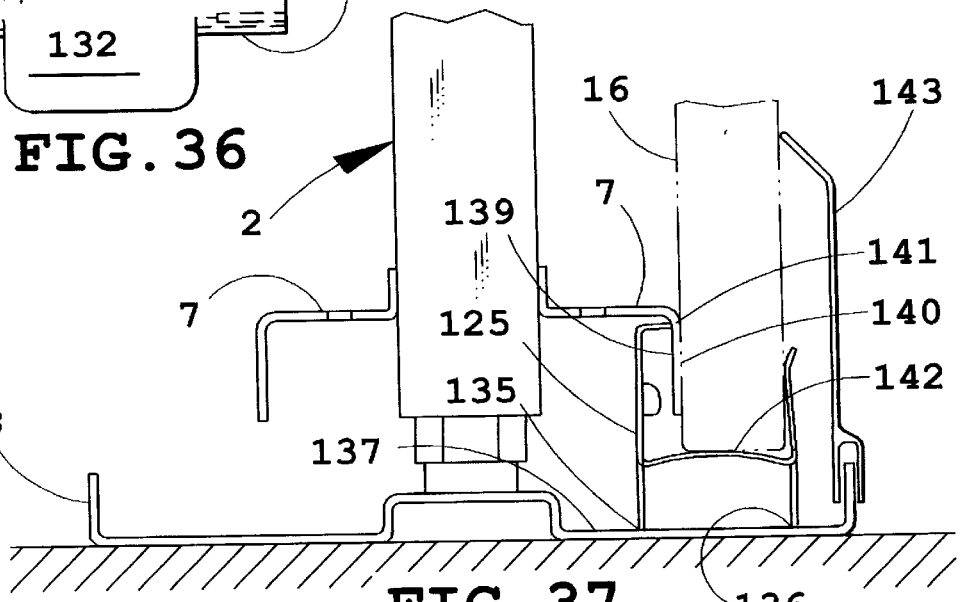
FIG. 37 is a fragmentary end view of the lower portion of the partition frame showing the panel clip of FIG. 34.

With reference to FIGS. 33–36, clip 125 is used to support a cover panel at the floor. As best seen in FIG. 35, the clip 125 includes center webs 126 and a pair of upwardly and inwardly-extending first and second legs 127 and 128 that terminate at first and second flanges 129 and 130, respectively. First and second tabs 131 and 132 extend downwardly from webs 126 and abut the floor surface along edges 135, 136. Clip 125 is clipped to the lower edge 15 of a lower cover panel 16 and supports the cover panel 16 directly on the inner surface 137 of floor channel 138 (FIG. 37). The edge 141 of flange 129 abuts the inner surface 139 of downwardly-extending flange 140 of horizontal frame rail or member 7, thereby retaining the lower edge 142 of panel 16 to the partition frame 2. Trim strip 143 clips to floor channel 138 to cover the clips 125. Clip 125 is attached to the lower edge of cover panel 16 by manually grasping the tabs 131 and 132 and flexing the tabs 131 and 132 inwardly, thereby flexing legs 127 and 128 outwardly such that the clip can be attached to the lower edge of the cover panel 16.

Figure 4:
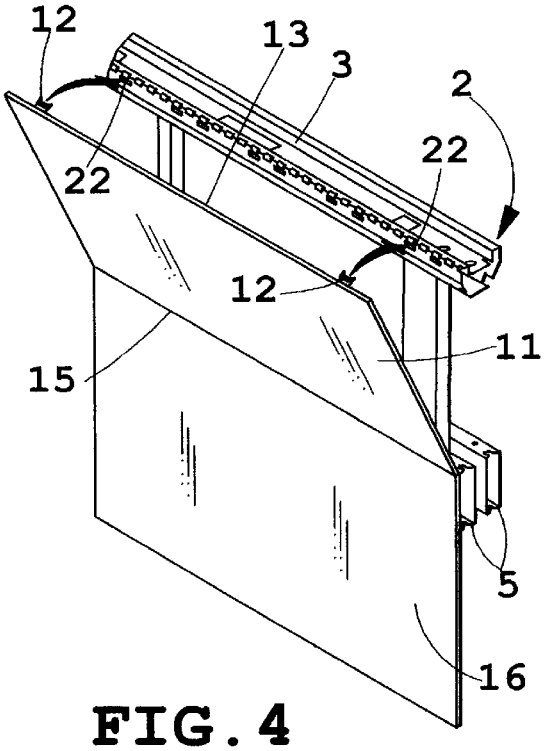
FIG. 4 is a fragmentary, perspective view illustrating the installation of the cover panel of FIG. 1.
Figure 5:
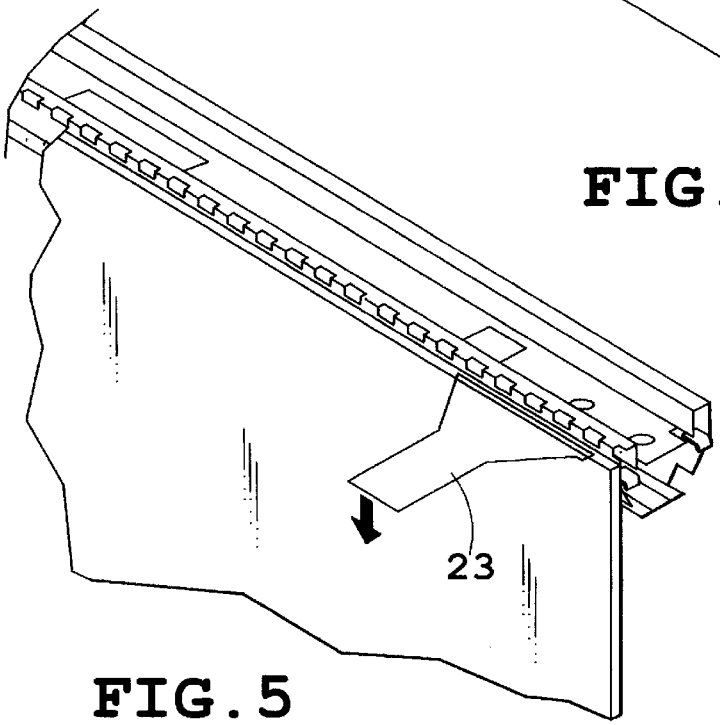
FIG. 5 is a fragmentary, perspective view illustrating a tool that is used to remove the cover panel of FIG. 1.

As best seen in FIGS. 3 and 4, a cover panel 11 is installed to the partition frame 2 by inserting the bottom fingers 14 between the lower cover panel 16 and the horizontal frame members 5. The upper edge 13 of the cover panel 11 is then rotated inwardly until the transversely-oriented V-shaped portion of clips 12 engage the apertures 22 in the horizontal frame member 3. As illustrated in FIG. 5, the cover panel is removed by using the tool 23 to depress the extension 104 of the V-shaped portion 101 of the clip. Depressing the extension 104 causes the retainer tab 105 to move out of abutting engagement with the inner surface of the horizontal frame member 5 such that the upper edge 13 of cover panel 11 may be removed from the partition frame 2. The cover panel 11 is then lifted upwardly to disengage the fingers 14 from between the horizontal frame member and the lower cover panel 16.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A partition construction, comprising:

a partition frame;

upper and lower cover panels covering a side of the partition frame;

a connection system on the upper cover panel releasable attaching the upper cover panel to the partition frame including:

a plurality of top clips on the upper cover panel adjacent an upper edge of the upper cover panel that positively engage the partition frame; and a plurality of bottom fingers, at least one of which is movably mounted to said upper cover panel and shifts between an extended position relative to said upper cover panel, wherein said bottom finger extends below a lower edge of the upper cover panel and engages at least a selected one of the lower cover panel and the partition frame at a location below the upper cover panel, and a retracted position relative to said upper cover panel wherein said bottom finger is disengaged from said lower cover panel and said partition frame.

2. The partition construction defined in claim 1, wherein said partition frame defines a side face, and said lower cover panel defines an inner surface immediately adjacent said side face, said bottom fingers positioned between and abutting said side face and said inner surface when in said extended position to retain said lower edge of said upper cover panel to said partition frame.

3. The partition construction defined in claim 1, wherein the bottom fingers are rigidly yet movably mounted to the upper cover panel, and include a resilient member biased into frictional engagement with said upper cover panel and retaining said bottom fingers in a selected one of said extended and retracted positions.

4. The partition construction defined in claim 3, wherein the fingers are fixed to the upper cover panel by threaded fasteners.

5. The partition construction defined in claim 1, wherein the partition frame includes a pair of vertically spaced-apart horizontal frame members, each having a horizontal row of evenly spaced discrete attachment locations that are adapted to attach hang-on accessory units.

6. The partition construction defined in claim 5, wherein the evenly spaced discrete attachment locations comprise a horizontal row of slots in the horizontal frame members.

7. The partition construction defined in claim 1, wherein the bottom fingers are received between the frame member and the lower cover panel.

8. The partition construction defined in claim 1, wherein the frame member includes discrete attachment locations, and wherein at least one of the bottom fingers is angled sidewardly to permit access to the discrete attachment locations of the frame member; and wherein the partition construction further includes at least one hang-on accessory unit removably connected to the frame member at the discrete attachment locations.

9. The partition construction defined in claim 8, wherein the discrete attachment locations comprise a horizontal row of evenly spaced slots in the frame member.

10. A partition construction, comprising:

a partition frame;

upper and lower cover panels covering a side of the partition frame;

a connection system on the upper cover panel releasable attaching the upper cover panel to the partition frame including:

a plurality of top clips on the upper cover panel adjacent an upper edge of the upper cover panel that positively engage the partition frame;

a plurality of bottom fingers extending below a lower edge of the upper cover panel that engage at least a selected one of the lower cover panel and the partition frame at a location below the upper cover panel; and said bottom fingers movably mounted to the upper cover panel adjacent a lower edge thereof, the fingers being movable between an extended position and a retracted position, and wherein the bottom fingers are pivotably mounted such that the fingers are rotatable about an axis that is substantially orthogonal to a front surface of the upper cover panel.

11. The partition construction defined in claim 10, wherein the bottom fingers have a substantially flat shape with a curved end portion.

12. The partition construction defined in claim 11, wherein the bottom fingers are metal.

13. The partition construction defined in claim 10, wherein the fingers include a resilient member that engages the upper cover panel to retain the fingers in a selected position.

14. The partition construction defined in claim 13, wherein the resilient member comprises a flexible tab extending from the finger and frictionally engaging the upper cover panel.

15. The partition construction defined in claim 12, wherein the partition frame includes a plurality of apertures adjacent inner surfaces of said partition frame, the apertures being located adjacent an upper portion of the partition frame, and wherein the top clips have a flexible, transversely-oriented, V-shaped portion defining first and second legs, the clips having a retainer tab extending from the first leg, the V-shaped portion being received in selected ones of said apertures with the first and second legs flexed toward one another, and the retainer tab abutting the inner surface of the partition frame and retaining the upper edge of the upper cover panel to the partition frame.

16. The partition construction defined in claim 15, wherein the upper cover panel has a generally rectangular shape defining top and bottom edges and a pair of opposite side edges, the upper cover panel being made from sheet metal and including an inwardly-opening U-shaped flange extending along a substantial portion of the top, bottom and side edges.

17. The partition construction defined in claim 15, wherein the upper cover panel has a generally rectangular shape with a perimeter defining top and bottom edges and a pair of opposite side edges, the upper cover panel including a frame extending around said perimeter, the upper cover panel further including a sheet of acoustic insulation and a layer of fabric material covering an outer side of the upper cover panel.

18. The partition construction defined in claim 15, wherein the upper cover panel includes a wood sheet defining a decorative outer surface.

19. A partition construction, comprising:

a partition frame;

upper and lower cover panels covering a side of the partition frame;

a connection system on the upper cover panel releasable attaching the upper cover panel to the partition frame including:

a plurality of top clips on the upper cover panel adjacent an upper edge of the upper cover panel that positively engage the partition frame; and a plurality of bottom fingers extending below a lower edge of the upper cover panel that engage at least a selected one of the lower cover panel and the partition frame at a location below the upper cover panel, and wherein the partition frame includes a horizontal base member extending along a floor, and the lower cover panel includes a plurality of bottom fingers that are pivoted sidewardly, the lower cover panel abutting the base member adjacent a lower edge of the lower cover panel and retained thereto by at least one clip.

20. A partition construction, comprising:

a partition frame having a frame member including a plurality of clip-receiving openings adjacent an outer surface of the frame member;

a first cover panel supported on and covering a portion of a front of the partition frame, and having an inner surface in abutment with said outer surface of said frame member;

a second cover panel located vertically adjacent the first cover panel, the second cover panel having a plurality of transversely-oriented resilient clips, and having at least one finger spaced from the clips and extending between and abutting at least a selected one of said first cover panel and said outer surface of the frame member and releasable retaining the second cover panel to the frame member;

wherein the second cover panel includes a plurality of bottom fingers extending below a lower edge of the second cover panel and between the first cover panel and a frame member of the partition frame located generally below the second cover panel and abutting said inner surface of said first cover panel and said outer surface of said frame member; and wherein the bottom fingers are movably mounted to the second cover panel adjacent a lower edge thereof, the fingers being movable relative to the second cover panel between an extended position and a retracted position.

21. A partition construction, comprising:

a partition frame having a frame member including a plurality of clip-receiving openings adjacent an outer surface of the frame member;

a first cover panel supported on and covering a portion of a front of the partition frame;

a second cover panel located vertically adjacent the first cover panel, the second cover panel having a plurality of transversely-oriented resilient clips, and having at least one finger spaced from the clips that abuts the outer surface of the frame member and releasable retains the second cover panel to the frame member;

the second cover panel including a plurality of bottom fingers extending below a lower edge of the second cover panel and between the first cover panel and a frame member of the partition frame located generally below the second cover panel;

the bottom fingers movably mounted to the second cover panel adjacent a lower edge thereof, the fingers being movable between an extended position and a retracted position, wherein the bottom fingers are pivotably mounted such that the fingers are rotatable about an axis that is substantially orthogonal to the second cover panel.

22. The partition construction defined in claim 21, wherein the fingers include a resilient member that engages the second cover panel to retain the finger in a selected angular position.

23. The partition construction defined in claim 22, wherein the resilient member comprises a flexible tab extending from the finger and frictionally engaging the second cover panel.

24. The partition construction defined in claim 23, wherein the partition frame includes a pair of vertically spaced-apart horizontal frame members, each having a horizontal row of evenly spaced discrete attachment locations that are adapted to attach hang-on accessory units.

25. The partition construction defined in claim 24, wherein the evenly spaced discrete attachment locations comprise a horizontal row of slots in the horizontal frame members.

26. The partition construction defined in claim 25, wherein the clip is releasable from the frame member by flexing the first and second legs inwardly such that the tab is removable from the clip-receiving opening.

27. A partition construction, comprising:

a partition frame including vertically spaced-apart upper and lower horizontal frame members, said lower horizontal frame member defining an outer surface;

upper and lower cover panels, each defining an inner surface and covering a side of the partition frame, the upper cover panel including a plurality of tabs extending below a bottom edge of the upper cover panel that are closely received between said inner surface of said lower cover panel and said outer surface of said lower horizontal frame member to thereby retain the bottom edge of the upper cover panel to the partition frame.

28. The partition construction defined in claim 27, wherein the tabs are elongated and have a substantially flat shape with a curved end portion.

29. The partition construction defined in claim 27, wherein the upper horizontal frame member includes clip-receiving apertures, and the upper cover panel includes clips that are releasable received in the clip-receiving apertures to retain an upper edge of the upper cover panel to the partition frame.

30. A partition construction, comprising:

a partition frame including vertically spaced-apart upper and lower horizontal frame members;

upper and lower cover panels covering a side of the partition frame, the upper cover panel including a plurality of tabs extending below a bottom edge of the upper cover panel that are closely received between the lower cover panel and the lower horizontal frame member to thereby retain the bottom edge of the upper cover panel to the partition frame; and tabs that are elongated and have a substantially flat shape with a curved end portion, wherein the tabs are pivotably mounted and are movable between an extended position wherein the tabs extend below a bottom edge of the upper cover panel, and a retracted position wherein the tabs are positioned above a bottom edge of the upper cover panel.

31. The partition construction defined in claim 30, wherein the tabs include a resilient member that engages the upper cover panel to retain the tab in a selected position.

32. The partition construction defined in claim 31, wherein the resilient member comprises a flexible tab that frictionally engages the cover panel.

* * * * *

UNITED STATES PATENT AND TRADEMARK OFFICE

CERTIFICATE OF CORRECTION

PATENT NO. : 6,000,180
DATED : December 14, 1999
INVENTORS : Steven F. Goodman et al.

It is certified that error appears in the above-identified patent and that said Letters Patent is hereby corrected as shown below:

Title page, item [57],
ABSTRACT, line 4;
"releasable" should be --releasably--.
Column 1, line 7;
"consigned," should be --coassigned,--.
Column 2, line 19;
"releasable" should be --releasably--.
Column 3, line 44;
After "Fig. 36", insert --is a--.
Column 4, line 4;
"releasable" should be --releasably--.
Column 5, line 59;
"cut-out" should be --cut out--.
Column 7, claim 1, line 5;
"releasable" should be --releasably--.
Column 7, claim 10, line 64;
"releasable" should be --releasably--.
Column 8, claim 19, line 61;
"releasable" should be --releasably--.

UNITED STATES PATENT AND TRADEMARK OFFICE

CERTIFICATE OF CORRECTION

PATENT NO. : 6,000,180
DATED : December 14, 1999
INVENTORS : Steven F. Goodman et al.

It is certified that error appears in the above-identified patent and that said Letters Patent is hereby corrected as shown below:

Column 9, claim 20, line 26;
"releasable" should be --releasably--.
Column 9, claim 21, line 50;
"releasable" should be --releasably--.
Column 10, claim 29, line 38;
"releasable" should be --releasably--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*